US006040755A

United States Patent [19]

Abe et al.

[11] Patent Number: 6,040,755

[45] Date of Patent: Mar. 21, 2000

[54] CHIP THERMISTORS AND METHODS OF MAKING SAME

[75] Inventors: Yoshiaki Abe; Toshiharu Hirota, both of Shiga, Japan

[73] Assignee: Murata Manufacturing Co., Ltd., Kyoto, Japan

[21] Appl. No.: 09/327,906

[22] Filed: Jun. 8, 1999

[30] Foreign Application Priority Data

Jul. 8, 1998 [JP] Japan ..... 10-192832
Feb. 16, 1999 [JP] Japan ..... 11-037546

[51] Int. Cl.[7] ..... H01C 7/10

[52] U.S. Cl. ..... 338/22 R; 338/314; 338/322; 338/328; 338/332

[58] Field of Search ..... 338/22 R, 306, 338/322, 314, 328, 332

[56] References Cited

U.S. PATENT DOCUMENTS 4,746,895 5/1988 Kato et al. ..... 338/272
5,488,348 1/1996 Asida et al. ..... 338/22 R
5,493,266 2/1996 Sasaki et al. ..... 338/22 R
5,534,843 7/1996 Tsunoda et al. ..... 338/22 R
5,907,272 5/1999 McGuire ..... 338/22 R

*Primary Examiner*—Lincoln Donovan
*Assistant Examiner*—Richard K. Lee
*Attorney, Agent, or Firm*—Majestic, Parsons, Siebert & Hsue P.C.

[57] ABSTRACT

A chip thermistor is produced by providing a planar rectangular thermistor block with a pair of electrodes formed on its surfaces, each of the electrode being formed so as to be in part on a different one of the main surfaces and extending continuously at least onto one of the side surfaces. The thermistor block thus prepared is cut transversely to obtain a plurality of thermistor elements. A specified number of these thermistor elements are then aligned and stacked one on top of another with their main surfaces facing each other. A layer of an insulating material such as glass with thickness greater than 10 $\mu$m is inserted between each mutually adjacently stacked pair of these thermistor elements. Outer electrodes are formed on the outer surfaces of the stacked structure so as to electrically connect to the electrodes on the stacked thermistor elements on their aligned end surfaces.

13 Claims, 3 Drawing Sheets

CHIP THERMISTORS AND METHODS OF MAKING SAME

BACKGROUND OF THE INVENTION

This invention relates to chip-type thermistors ("chip thermistors") and methods of making such thermistors. More particularly, the invention relates to positive temperature characteristic (PTC) chip-type thermistors used for protection against overcurrents and methods of making such chip thermistors.

PTC chip thermistors used for protection against overcurrents are incorporated into the circuitry of an electronic device such that it will emit heat when there is an overcurrent in excess of a specified current intensity flowing therethrough, causing its resistance to increase due to its positive temperature characteristic and thereby reducing the current flowing into the device to a level below a specified maximum current value. Such PTC thermistors are desired to have a reduced resistance such that its power loss due to the lowering of voltage can be reduced, and it has been proposed to electrically connect a plurality of PTC thermistor elements in parallel such that the total resistance of the combination can be reduced according to the number of the thermistors to be connected.

For example, Japanese Patent Publication Tokkai 6-267709 disclosed a PTC thermistor 1*a,* as shown in FIG. 7, formed by stacking a plurality of planar PTC thermistor elements 2 one on top of another, each of the PTC thermistor elements 2 having electrodes 3*a* and 4*a* formed on its main surfaces. The mutually opposite pair of electrodes 3*a* or 4*a* of each mutually adjacent pair of these PTC thermistor elements 2 is joined together by means of an electrically conductive adhesive agent 5. In order to establish mutually insulated condition, furthermore, an electrically insulating material 6*a* fills open spaces between the electrodes 3*a* and 4*a*.

As another example, Japanese Patent Publication Tokkai 6-302404 disclosed a PTC thermistor 1*b,* as shown in FIG. 8, formed by stacking a plurality of planar PTC thermistor elements 2 one of top of another, each of the PTC thermistor elements 2 having electrodes 3*b* and 4*b* formed on its main surfaces. The mutually opposite pair of electrodes 3*b* or 4*b* of each mutually adjacent pair of these PTC thermistor elements extends in the same direction. Each adjacent pair of the PTC thermistor elements 2 is joined together by means of a glass material 6*b*. The pairs of electrodes 3*b* and 4*b* are extended in mutually opposite directions in alternate layers, and outer electrodes 7 and 8 are formed on the mutually opposite end surfaces of the stacked assembly of the PTC thermistor elements 2 such that the electrodes 3*b* and 4*b* can be electrically connected in parallel.

The prior art PTC thermistors 1*a* and 1*b* described above cannot be produced with a high work efficiency because the PTC thermistor elements 2 must be stacked carefully such that the electrodes 3*a* and 4*a* are accurately aligned through layers of the adhesive agent 5 in the case of the thermistors 1*a* of FIG. 7 and that the electrodes 3*b* and 4*b* will extend alternately in different directions in the case of the thermistor 1*b* of FIG. 8.

SUMMARY OF THE INVENTION

It is therefore an object of this invention to provide chip-type thermistors with low resistance which can be produced easily without the necessity of arranging the direction of extension of the inner electrodes when thermistor elements are stacked one on top of another, as well as methods of making such chip-type thermistors.

To produce a chip thermistor embodying this invention, with which the above and other objects can be accomplished, one might start with a planar rectangular thermistor block and a pair of electrodes is formed on its surfaces. The thermistor block has a pair of mutually oppositely facing main surfaces elongated in a longitudinal direction and a pair of mutually oppositely facing side surfaces. A first electrode is formed so as to be in part on one of the main surfaces and extending continuously onto one of the side surfaces, while the second electrode is in part on the other of the main surfaces and extends continuously onto the other of the side surfaces. The thermistor block thus prepared is thereafter cut transversely to the longitudinal direction, and a plurality of thermistor elements are obtained, the side surfaces of the original thermistor block becoming the end surfaces of the individual thermistor elements. A specified number of these thermistor elements are then aligned and stacked one on top of another with their main surfaces facing each other. A layer of an insulating material such as glass with thickness greater than 10 $\mu$m is inserted between each mutually adjacently stacked pair of these thermistor elements. A stacked structure thus formed has a mutually oppositely facing outer surfaces where the electrodes on the individual stacked thermistor elements are exposed to the exterior. Outer electrodes are formed on these outer surfaces of the stacked structure so as to electrically connect to the electrodes on the stacked thermistor elements.

The first and second electrodes on each thermistor element may be formed so as to each cover a major portion of one of the main surfaces, to extend continuously over one of the end surfaces and further over a portion of the other main surface. Each of the main surfaces of the stacked structure may be covered with a layer of an electrically insulating material such as glass.

A chip thermistor thus structured is advantageous in that the thermistor elements which are stacked one on top another are dependably insulated from one another and one need not be careful of the directions in which they face as they are stacked. Thus, the production work efficiency is improved and the rise in the temperature of the circuit board to which it is mounted can be reduced.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

Throughout herein, same or similar constituent parts are sometimes indicated by the same numerals for convenience and are not necessarily described or explained repetitiously even where they are constituent parts of different PTC chip thermistors or elements.

DETAILED DESCRIPTION OF THE INVENTION

Figure 1:
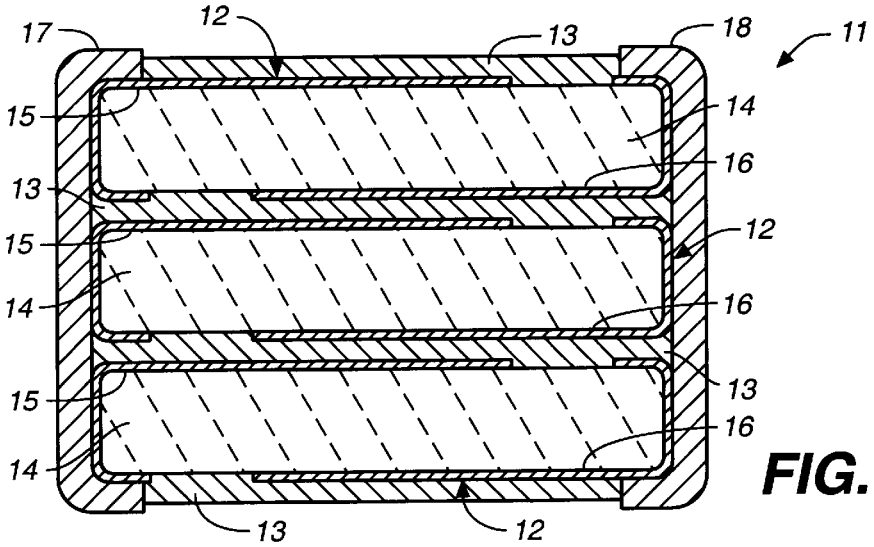
FIG. 1 is a sectional view of a PTC chip thermistor embodying this invention.

The invention is described next by way of examples with reference to the drawings. FIG. 1 shows a PTC chip thermistor 11 embodying this invention (Example 1) having three planar PTC thermistor elements 12 stacked one on top of another with insulating layers 13 in between and outer electrodes 17 and 18 on both side surfaces of the stacked PTC thermistor elements 12.

Figure 2A:
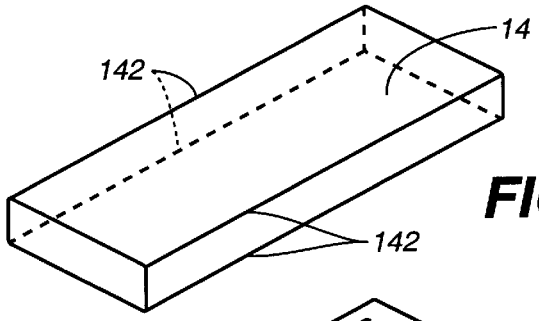
FIG. 2 shows a method of forming the PTC chip thermistor shown in FIG. 1, FIG. 2A showing a PTC thermistor block, FIG. 2B showing the PTC thermistor block after a Ni film is formed on its surfaces, and FIG. 2C showing the PTC thermistor block after portions of its film are removed.
Figure 2B:
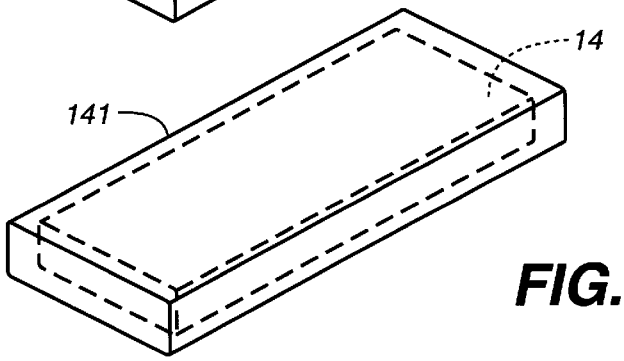
Figure 2C:
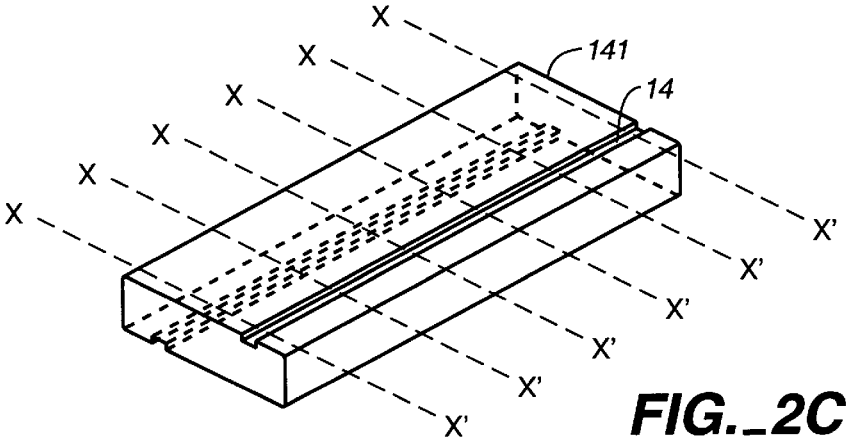
Figure 3:
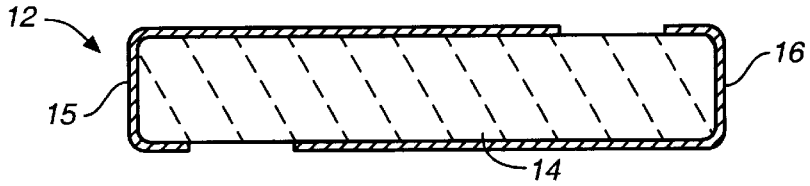
FIG. 3 is a sectional view taken longitudinally from one of the lines X-X' shown in FIG. 2C.

This PTC chip thermistor 11 is produced firstly by preparing an elongated rectangular planar PTC thermistor block 14, as shown in FIG. 2A. Next, a thin film of Ni 141 is formed on the surfaces of this PTC thermistor block 14 by electroless plating, as shown in FIG. 2B. After stripe-shaped linear portions of the Ni film 141 each on one of the main surfaces of the PTC thermistor block 14 along and near a longitudinally extending side surface are removed by sand blasting, as shown in FIG. 2C, the PTC thermistor block 14 is sliced along lines X-X'. PTC elements 12 with length 4.5 mm, width 3.2 mm and height 0.3 mm, having inner electrodes (herein thus referred to, although they are not internally disposed before the individual PTC thermistor elements 12 are stacked) 15 and 16 thereon, as shown in FIG. 3, were thus obtained. The side surfaces of the PTC thermistor block 14 before it was cut are now end surfaces of the PTC thermistor elements 12. The inner electrode 15 covers a major portion of one of the (first) main surfaces of the PTC thermistor block 14, extending therefrom over one of the end surfaces to reach and covers a small portion of the other (second) main surface. The other inner electrode 16 covers a major portion of the other (second) main surface, extending therefrom over the other of the end surfaces to reach and covers a small portion of the first main surface.

Prior to the electroless plating process, it is preferable to bevel edge portions 142 of the PTC thermistor block 14 each between one of the main surfaces and one of the side surfaces such that the Ni film 141 can attach evenly over each edge portion 142 of the PTC thermistor block 14 and that a cut in the inner electrodes 15 and 16 at the edge potions 142, as well as occurrence of a condition of poor electrical conduction caused by such a cut, can be dependably prevented.

Next, one of the main surfaces of a first one of the PTC thermistor elements 12 is completely coated with a glass paste. A second one of the PTC thermistor elements 12 is placed on top of it with its second main surface overlapping the first PTC thermistor element in a face-to-face relationship, and its first main surface is completely coated likewise with the glass paste. A third PTC thermistor element is similarly placed on top of the second PTC thermistor element and its first main surface is coated with the glass paste either entirely or by excepting edge portions where the outer electrodes 17 and 18 are to be formed. By a firing process, not only are these three PTC thermistor elements 12 connected one another with insulating glass layers 13 in between, but the externally facing main surfaces of the stacked structure (the first main surface of the first PTC thermistor element at the bottom and the second main surface of the third PTC thermistor element at the top, as shown in FIG. 1) are also each covered with an insulating glass layer 13. In order to keep the electrodes 15 and 16 on mutually adjacent pairs of the stacked PTC thermistor elements 12 in a mutually insulated relationship, it is preferable to make the thickness of the insulating glass layers 13 therebetween greater than 10 $\mu$m. The PTC chip thermistor 11 is obtained by thereafter forming the outer electrodes 17 and 18 by baking an Ag paste on the both end surfaces of the stacked structure of the PTC thermistor elements 12 such that the portions of the inner electrodes 15 and 16 exposed on their end surfaces can be individually connected electrically.

A glass paste may be further applied on both main surfaces and side surfaces of the stacked PTC thermistor elements 12 (that is, the surfaces towards and away from the reader in the sectional view of FIG. 1), either entirely or except for the areas where the outer electrodes 17 and 18 are to be formed, and baked such that four of the externally facing surfaces (the two main surfaces and the two side surfaces, but not the two end surfaces) are covered by an insulating material.

The outer electrodes 17 and 18 may be formed alternatively, after the PTC thermistor elements 12 are stacked one on top of another with the glass layers 13 in between as described above, by immersing it in a glass paste to cover its surfaces with glass layers, applying an Ag paste on both end surfaces of this stacked structure and then subjecting it to a baking process. By this baking process, the glass material of the glass layers 13 diffuses into the Ag which covers them, thereby forming the outer electrodes 17 and 18 connected electrically to the parts of the inner electrodes 15 and 16 on the end surfaces of the individual PTC thermistor elements 12. This method is more convenient for covering the four outer surfaces of the stacked PTC thermistor elements 12 (except the two end surfaces) with glass layers 13 than the method by applying an Ag paste.

The PTC chip thermistor 11 thus structured is characterized as having glass layers 13 with a sufficient thickness for insulation inserted between stacked PTC thermistor elements 12. Thus, the inner electrodes 15 and 16 on mutually adjacent ones of the PTC thermistor elements 12 are dependably insulated from each other, independent of their directions. Thus, a plurality of PTC thermistor elements 12 can be electrically connected in parallel by forming the outer electrodes 17 and 18 on the both end surfaces of the stacked PTC thermistor elements 12. Since the inner electrodes 15 and 16 are exposed externally from the stacked PTC thermistor elements 12, furthermore, they can be dependably connected electrically to the outer electrodes 17 and 18, improving the reliability. Since each of the inner electrodes 15 and 16 is formed over three surfaces (two main and one end surfaces) of the corresponding PTC thermistor element 12, it can be reliably insulated from the other inner electrode 15 or 16 even on the PTC thermistor element 12 at the top or the bottom of the stack, although the outer electrodes 17 and 18 extend somewhat on the main surfaces of the PTC chip thermistor 11. Still another advantage of the PTC chip thermistor 11 thus structured is that, since at least its main surfaces are covered with glass layers 13, a short circuit due to displacement or dislocation can be reliably prevented after it is mounted to a circuit board and connected to a conductive land thereon.

Figure 4:
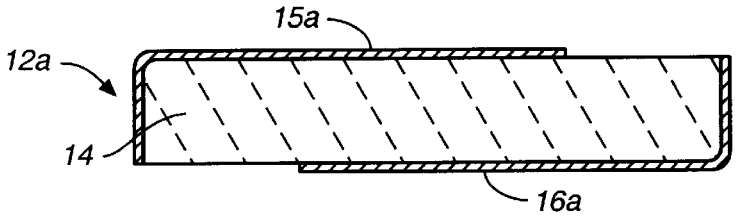
FIG. 4 is a sectional view of another PTC thermistor element.
Figure 5:
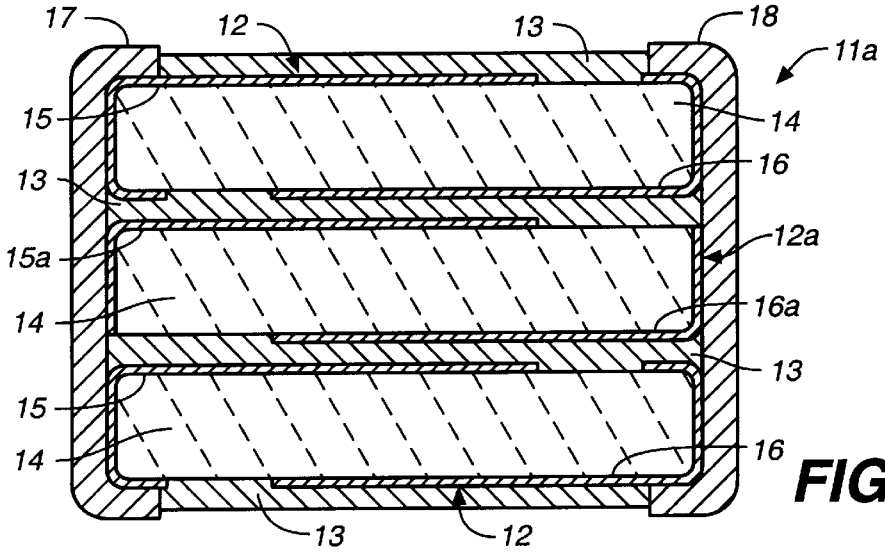
FIG. 5 is a sectional view of another PTC chip thermistor embodying this invention.

Another PTC chip thermistor 11*a* embodying this invention (Example 2) is explained next with reference to FIGS. 4 and 5 wherein like or equivalent constituent parts as described above are indicated by the same symbols. In order to produce such a PTC chip thermistor 11*a*, PTC thermistor elements 12*a* with a design different from the PTC thermistor element 12 shown in FIG. 3 are additionally prepared, that is, the PTC thermistor element 12*a* has one inner electrode 15*a* formed on one of the end surfaces of a planar rectangular PTC thermistor block 14 and extending to and covering a major portion of one of the main surfaces of the PTC thermistor block 14 and another inner electrode 16*a* on the other of the end surfaces of the PTC thermistor block 14 and extending to and covering a major portion of the other of the main surfaces of the PTC thermistor block 14. Seen sectionally, as shown in FIG. 4, these inner electrodes 15*a* and 16*a* are each in the form of an L, without contacting each other.

Next, a glass paste is applied entirely on one of the main surfaces of a (first) PTC thermistor element, and another (second) PTC thermistor element 12*a* is placed thereon with one of its main surfaces in a face-to-face relationship with the main surface of the first PTC thermistor element 12 with the glass paste applied thereon. The other main surface of the second PTC thermistor element 12*a* distal of the first PTC thermistor element 12 is entirely covered with the glass paste, and still another (third) PTC thermistor element 12 of the type shown in FIG. 3 is placed thereon with one of its main surfaces in a face-to-face relationship with the second PTC thermistor element 12*a*. The glass paste is applied to the other main surface (exposed at the top) of the third PTC thermistor 12 either entirely or excepting areas where outer electrodes may be formed. The glass paste is also applied to the main surface of the first PTC thermistor element 12 distal of the second PTC thermistor element 12*a* either entirely or excepting areas for the outer electrodes to be formed. The stacked structure thus formed is baked next, and outer electrodes 17 and 18 are finally formed on the respective end surfaces of the stacked structure by baking Ag so as to be electrically connected to the inner electrodes 15, 15*a*, 16 and 16*a*. The PTC chip thermistor 11*a* (Example 2) is thus obtained.

The PTC chip thermistor 11*a* of Example 1 is different from the PTC chip thermistor 11 of Example 2 in that the two inner electrodes 15*a* and 16*a* on the second PTC thermistor element 12*a* face each other over a larger area. Thus, the total resistance of the PTC chip thermistor 11*a* connecting the three PTC thermistor elements 12 and 12*a* (two of the type 12 and one of the type 12*a*) as shown in FIG. 5 can be made smaller than that of the PTC chip thermistor 11 connecting three PTC thermistor element 12 as shown in FIG. 1.

Figure 6:
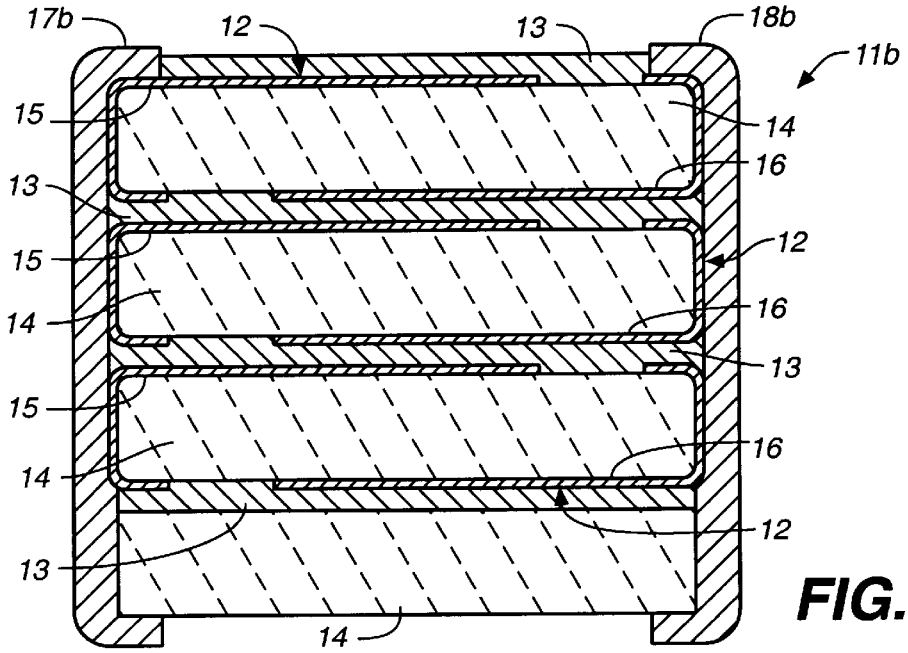
FIG. 6 is a sectional view of still another PTC chip thermistor embodying this invention.
Figure 7:
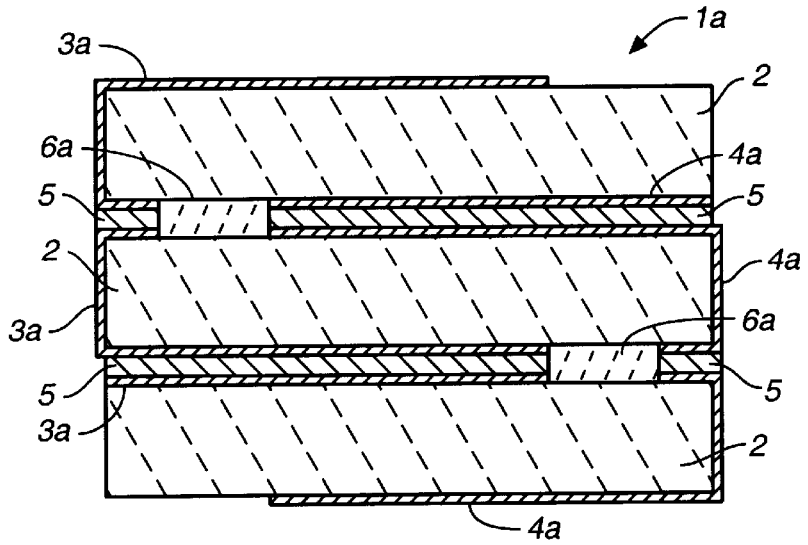
FIG. 7 (PRIOR ART)
FIG. 7 is a sectional view of a prior art PTC chip thermistor.
Figure 8:
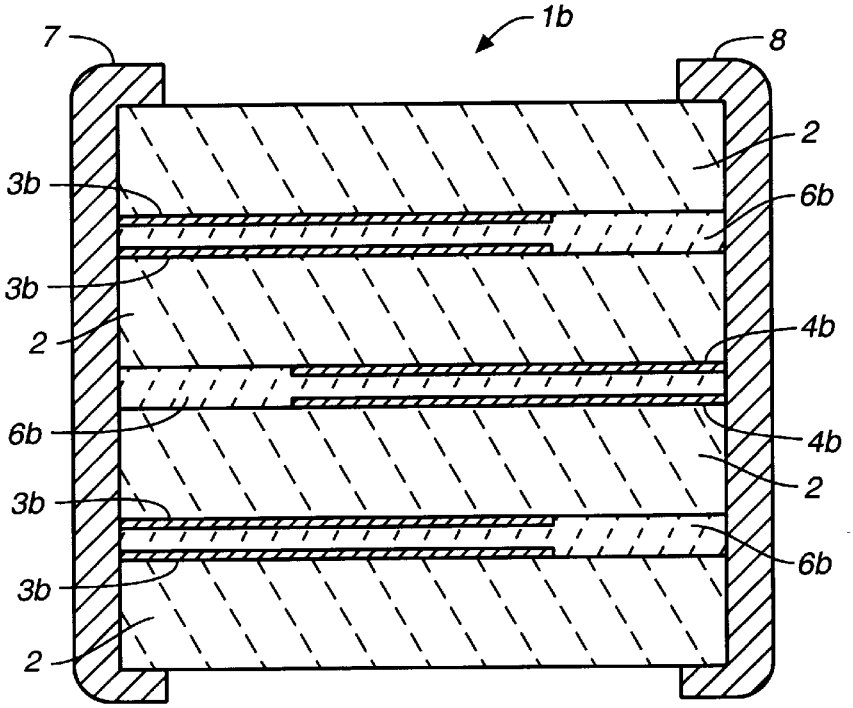
FIG. 8 (PRIOR ART)
FIG. 8 is a sectional view of another prior art PTC chip thermistor.

Still another PTC chip thermistor 11*b* embodying this invention (Example 3) is explained next with reference to FIG. 6 wherein like or equivalent constituent parts as described above are again indicated by the same symbols. To produce this PTC chip thermistor 11*b*, a PTC thermistor block 14 having no inner electrodes 15 and 16 formed thereon is prepared in addition to three PTC thermistor elements 12 shown in FIG. 3. After one of the main surfaces of the PTC thermistor block 14 is completely covered with a glass paste, one of the three PTC thermistor elements 12 is placed thereon, and the process of forming the stacked structure for the production of the PTC thermistor unit 11 described above is repeated. The other main surface of the PTC thermistor block 14 is covered with the glass paste either entirely or excepting areas for forming outer electrodes, and outer electrodes 17*b* and 18*b* for baked Ag are formed on the end surfaces of the stacked structure with the PTC thermistor block 14 and the three PTC thermistor elements 12.

In general, if the resistance of a block of a ceramic material is made smaller, the element comprising the block generates more heat, causing troubles because the generated excessive heat is conducted to the circuit board on which it is mounted and raises its temperature such that not only the circuit board itself but also devices mounted in the proximity are adversely affected. The extra PTC thermistor block 14 of the PTC chip thermistor 11*b* serves to inhibit the propagation of heat from the PTC thermistor elements 12 to the circuit board, reducing the rise in temperature of the circuit board.

In order to compare Examples 1 and 3, six samples each of PTC chip thermistors 11 and 11*b* were individually mounted to a circuit board and the surface temperature of each circuit board was measured when a same voltage was applied. The measured surface temperature values were 148° C., 155° C., 150° C., 153° C., 147° C. and 150° C. with the samples of Example 1 and 112° C., 110° C., 105° C., 108° C., 111° C. and 110° C. with the samples of Example 3. The average values were 150° C. for Example 1 and 109° C. for Example 3, the difference therebetween being greater than 40° C. This clearly shows that the heat from the PTC chip thermistor 11*b* is less likely to propagate to the circuit board and hence its surface temperature is slow to rise.

Although the invention has been described above with reference to only a limited number of examples, these examples are not intended to limit the scope of the invention. Many modifications and variations are possible within the scope of the invention. The PTC thermistor blocks 14 may be of any other insulating or nearly insulating material providing a resistance value of greater than $10^6$ Ω between the electrodes 17*b* and 18*b*. An extra PTC thermistor block 14 may be further attached on top of the top PTC thermistor element 12 of the PTC chip thermistor 11*b* through a glass paste such that the resultant PTC chip thermistor will have a PTC thermistor block both on its top and bottom sides.

In all of the Examples, the inner electrodes 15, 15*a*, 16 and 16*a* may comprise a metal of any kind capable of exhibiting an ohmic characteristic such as Cr and Al. They may be formed by sputtering, vapor deposition, printing and baking or any combination of these. The outer electrodes 17 ad 18 may comprise any metal with good solderability and may be created by forming an upper layer of solderable metal such as Sn above a baked Ag layer. They may also be formed by any of various methods such as sputtering, vapor deposition, printing and baking, soldering and any combination of these. The number of PTC thermistor elements 12 and/or 12*a* to be stacked to form a PTC chip thermistor 11, 11*a* or 11*b* is not limited to three. The number may be freely changed and it is preferred to increase or decrease this number, depending on the purpose of use, although five to six thermistor elements are generally stacked. Although glass layers 13 were used to attach the PTC thermistor elements 12 and 12*a* and PTC thermistor blocks 14, any other insulating material other than glass, such as resin materials, may be substituted. As for the methods of production, a glass paste may be applied to the individual PTC thermistor elements 12 and/or 12*b* to insulate them before they are joined together. In this manner, it is possible to obtain glass layers of a specified thickness and insulate them in a reliable manner.

Finally, although the invention was described in terms of PTC chip thermistors, it goes without saying that the invention can relate equally well to negative temperature characteristic (NTC) chip thermistors.

In summary, chip thermistors of this invention have many advantages. They can have their resistance reduced by stacking a plurality of planar thermistor elements and connecting them in parallel such that the overall resistance is reduced according to the number of PTC thermistor elements connected in parallel. Since a plurality of thermistor elements are stacked one on top of another, the mechanical strength of the chip thus formed is improved, and this makes it possible to use thin planar thermistor elements. Since the thermistor elements are stacked with plates of a nearly insulating material inserted in between, furthermore, the directions in which the individual thermistor elements are stacked are not important, and this makes their production process simpler. Since the inner electrodes are formed so as to extend from one main surface of the thermistor block over a side surface to reach the opposite main surface, they can securely contact an outer electrode over a sufficiently large contact area. If an extra thermistor block is inserted as in Example 3, furthermore, the surface temperature of the circuit board on which the chip is mounted can be reduced such that ill effects of heat to the circuit board and other devices in the proximity can be reduced.

What is claimed is:

1. A chip thermistor comprising:

a plurality of planar thermistor elements stacked one on top of another;

insulating layers each disposed between said thermistor elements and insulating one from the other of a different mutually adjacent pair of said thermistor elements; and a pair of outer electrodes;

wherein each of said thermistor elements has a mutually oppositely facing pair of end surfaces, a mutually oppositely facing pair of main surfaces each extending between said pair of end surfaces, and a pair of inner electrodes;

wherein each of said insulating layers entirely covers the main surfaces of the corresponding pair of said thermistor elements;

wherein one of said inner electrodes is in part on one of said main surfaces and extends continuously onto one of said end surfaces and the other of said inner electrodes is in part on the other of said main surfaces and extends continuously onto the other of said end surfaces;

wherein said thermistor elements are stacked through the main surfaces to together form a stacked structure with a mutually oppositely facing outer surfaces;

wherein each of said outer electrodes is formed on a respective one of said outer surfaces and is electrically connected to a different one of the inner electrodes of each of said thermistor elements on an associated one of the end surfaces thereof; and wherein the inner electrodes on different ones of said thermistor elements are electrically connected to each other only through one of said outer electrodes.

2. The chip thermistor of claim 1 wherein one of said inner electrodes is in part on a major portion of one of said main surfaces and the other of said inner electrodes is in part on a major portion of the other of said main surfaces.

3. The chip thermistor of claim 1 wherein one of said inner electrodes is in part on a major portion of one of said main surfaces and extends continuously over one of said end surfaces and further over a portion of the other of said main surfaces, and wherein the other of said inner electrodes is in part on a major portion of the other main surface and extends continuous over the other of said end surfaces and further over a portion of the one main surface.

4. The chip thermistor of claim 1 wherein each of said main surfaces is covered with a layer of an electrically insulating material.

5. The chip thermistor of claim 1 wherein said insulating layers are each of thickness greater than 10 $\mu$m.

6. The chip thermistor of claim 1 further comprising an electrically insulating plate attached to one of main surfaces of said stacked structure.

7. The chip thermistor of claim 1 wherein said thermistor elements have beveled edge lines.

8. A method of making a chip thermistor comprising the steps of:

providing a planar rectangular thermistor block with a pair of mutually oppositely facing main surfaces elongated in a longitudinal direction and a pair of mutually oppositely facing side surfaces extending in said longitudinal direction between said pair of main surfaces;

forming a first electrode and a second electrode, said first electrode being in part on one of said main surfaces and extending continuously onto one of said side surfaces, said second electrode being in part on the other of said main surfaces and extending continuously onto the other of said side surfaces;

thereafter cutting said thermistor block transversely to said longitudinal direction to thereby obtain a plurality of thermistor elements;

producing a stacked structure by stacking said plurality of thermistor elements one on top of another with an insulating layer inserted between each mutually adjacently stacked pair of said thermistor elements so as to entirely cover the main surfaces of said stacked pair of thermistor elements, said stacked structure having mutually oppositely facing outer surfaces, portions of the first electrodes and the second electrodes of the stacked thermistor elements on the side surfaces thereof being aligned on said outer surfaces; and forming a pair of outer electrodes each on a different one of said outer surfaces of said stacked structure, each of said outer electrodes being electrically connected to those of the first electrodes and the second electrodes of the stacked thermistor elements.

9. The method of claim 8 wherein said first electrode is formed so as to be in part on a major portion of the one main surface, extending continuously onto the one side surface and further onto the other main surface, and wherein said second electrode is formed so as to be in part on a major portion of the other main surface, extending continuously onto the other side surface and further onto the one main surface.

10. The method of claim 8 wherein said first electrode and said second electrode are formed by forming an electrically conductive layer entirely on said main surfaces and on said side surfaces and removing strips of said conductive layer in said longitudinal direction to thereby form separations between said first electrode and said second electrode on said main surfaces.

11. The method of claim 8 further comprising the step of covering at least each of externally exposed surfaces of said stacked structure parallel to the main surfaces of the stacked thermistor elements with an electrically insulating plate.

12. The method of claim 8 further comprising the step of attaching an electrically insulating plate to one of externally exposed surfaces of said stacked structure parallel to the main surfaces of the stacked thermistor elements.

13. The method of claim 8 wherein said outer electrodes are formed by immersing said stacked structure in a glass paste to form glass layers over all outer surfaces thereof, applying an silver paste on said outer surfaces and baking the silver paste to cause glass material of said glass paste on said outer surfaces to diffuse into said silver paste.

* * * * *